US005630557A

United States Patent [19]

Barthelmess

[11] Patent Number: 5,630,557

[45] Date of Patent: May 20, 1997

[54] STIRRING BEAD MILL WITH SEPARATOR TO STRAIN OUT GRINDING BEADS

[75] Inventor: Ulrich Barthelmess, Niederstotzingen, Germany

[73] Assignee: OMYA GmbH, Germany

[21] Appl. No.: 579,813

[22] Filed: Dec. 28, 1995

[30] Foreign Application Priority Data

Dec. 31, 1994 [DE] Germany ..... 44 47 321.4

[51] Int. Cl.[6] ..... B02C 17/16

[52] U.S. Cl. ..... 241/80; 241/171; 241/172

[58] Field of Search ..... 241/80, 97, 171, 241/172

[56] References Cited

U.S. PATENT DOCUMENTS

| | | | |
|---|---|---|---|
| 3,653,600 | 4/1972 | Shold . | |
| 4,754,934 | 7/1988 | Ikebuchi et al. | 241/172 X |
| 4,860,957 | 8/1989 | Lidström . | |
| 5,197,680 | 3/1993 | Chauveau | 241/172 X |
| 5,330,112 | 7/1994 | Nagaoka et al. | 241/172 X |

FOREIGN PATENT DOCUMENTS

| | | | |
|---|---|---|---|
| 193360 | 7/1992 | Japan | 241/172 |
| 1475709 | 4/1989 | U.S.S.R. | 241/172 |

OTHER PUBLICATIONS

Ullmanns Encyklopädie der technischen Chemie; 4., neubearbeitete und erweiterte Auflage, Band 2, Verlag Chemie, Weinheim/Bergstr. 1972; pp. 67–68 entry for "Korbsichter" (Basket Sifter).

*Primary Examiner*—Mark Rosenbaum
*Attorney, Agent, or Firm*—Dvorak and Traub

[57] ABSTRACT

The invention relates to a stirring mill in whose grinding tank, provided with an inlet and an outlet, and charged with a load of grinding beads, a stirring shaft (stirring mechanism) provided with stirrers, is rotatable, on which, for holding back the grinding beads a separator is mounted ahead of the outlet and is provided with radial openings. The invention is addressed to the problem of creating a stirring mill with a grinding bead separator whose separation limit corresponds to the upper grain size of the fines, by which sieves or filters for holding back the grinding beads are avoided, and which nevertheless sufficiently assures that no grinding beads or particles of dispersants can enter into the finish-ground product. This problem is solved by the fact that the separator is formed by a rotor in the manner of a centrifugal force sifting rotor (6) wherein the passages are formed by the interstices or spaces between every two sifter rotor paddles (10).

8 Claims, 7 Drawing Sheets

18
20
23
19
22
24
17
15
26
16
12
14
26a
14
21
6
2a
10
7
25
10
8
11
13
3
9
2
1
3

STIRRING BEAD MILL WITH SEPARATOR TO STRAIN OUT GRINDING BEADS

BACKGROUND OF THE INVENTION

In the production of plastics, paints, clays, pharmaceuticals, foods etc., various materials have to be reduced to ever finer particle sizes and mixed together or dispersed in fluids. In the production of paper, for example, the paper web issuing from a paper machine is coated with a lime-water suspension which has a fineness of about 5 μm. In the preparation of this coating substance ("slurry" hereinafter), broken limestone from quarries or mines is crushed ever more finely down to the fineness referred to above.

Stirring bead mills serve for the production of fine products of this kind, especially slurries. Increasingly smaller grinding beads are used, as the fineness increases, so as to reduce the areas of contact between two grinding beads and particles that are still too coarse, thereby intensifying the grinding action. But the smaller the beads are the more difficult it is to hold them back in the grinding tank, so that only the sufficiently fine time particles will enter together with the suspending water into the fine material or end product, but not the grinding beads. This difficulty becomes still greater as the grinding beads become worn ever smaller in the course of operation.

During the development of the present invention it was learned that the grinding action is improved when the grinding beads do not have more or less the same size but when beads of different sizes operate together in the mill, for this increases the probability that the limestone particles of various sizes will be ground between grinding beads of matching size, i.e., larger particles will be ground between larger grinding beads and smaller particles between smaller grinding beads; it is important too that increasingly fine grinding beads be present as the fineness of the limestone particles increases.

At the same time it is to be considered that in the grinding process the grinding beads become ever smaller due to wear. While the mill operates, grinding beads of appropriate larger initial diameter can be added—most practically together with the coarse dispersion that is to be comminuted—and will become continually smaller as they operate within the mill, resulting in a range of sizes from large through medium to small and minimum size grinding beads. Initially, however, a mixture of grinding beads of varying sizes can be charged into the mill.

In particular it was recognized that the best grinding action is achieved when the grinding beads are completely worn away in the mill, i.e., when the grinding beads are retained in the mill until they have reached the maximum grain size of the fine suspension desired, i.e., of the end product. With the mills of the prior art this can be achieved only with difficulty.

This is because usually sieves for straining out the grinding beads are disposed at the discharge end of the grinding tank, between the grinding chamber and the fine product outlet. The sieve holes thus determine the size of the particles in the fine product: larger particles are held out by the sieve, finer ones pass through it. The finest sieves that can be used practically have sieve holes of about 100 μm. This means that the fineness of the lime particles as well as that of the grinding beads that pass through amounts to about 100 μm. This grain size is too large for a great many applications: a finer grain size of under 40 μm is sought.

In the course of operation, however, the sieve holes and the sieve itself as a whole become clogged. A blanket then forms on the sieve and acts as a filter. This means that a pressure loss builds up as this process of forming a blanket on the sieve and clogging it progresses. Consequently the throughput, i.e., the amount of finished product produced per unit time, decreases. Therefore the sieve has to be reverse-flushed very often in order to remove the blanket or filter cake, resulting in down time and loss of production.

On account of the difficulties involved, attempts were made decades ago to hold out the grinding beads without sieves or filters.

In U.S. Pat. No. 3,653,600, a stirring bead mill was disclosed having a separator formed essentially by a cylindrical ring which is provided with a series of more or less radial bores uniformly distributed over the circumference. At the bottom end of this radially perforated ring a hub is formed, by which the separator is fastened on the shaft. Between the upper margin of the separator and the top cover of the mill a gasket is placed.

By means of such a separator the grinding beads are held back in the grinding chamber only by centrifugal force, so that sieves or filters with their above-mentioned problems could be avoided. However, this separator has found no acceptance in practice.

This might be due to the fact that the radial bores, despite their great number, generally offer a much too small cross section for the fine suspension flowing to them. In each of the many, relatively narrow bores the cross section is accordingly small, so that the velocity of flow is accordingly high, so that the centrifugal force cannot produce its effect. In this case it should be considered that centrifugal force increases with the square of the radius, i.e., is greatest radially outward and decreases radially inward by the square. Accordingly, the retention can take place substantially at the outer circumference alone, where the centrifugal force is correspondingly greatest: once particles have been drawn into a radial bore they are immediately subjected to a centrifugal force decreasing by the square, while the force of the flow is high in accord with the narrow cross section. Once particles are captured in a radial bore they no longer have any chance to be thrown outwardly. This is all the more true if, according to the embodiments of this patent, the separator body is surrounded by a sieve or filter, i.e., each radial bore is covered by a filter through which a particle—if it could at all penetrate radially into the bore—would have to be flung back out again by the sieve.

Other previously known attempts to create a bead retention without a sieve or filter consist in the fact that a plurality of plates at a small distance apart from one another are provided between the grinding chamber and the outlet chamber, forming gaps between them. The width of the gaps is smaller than the beads that are to be held out; smaller beads can flow through the gaps together with the fine product. However, even if a great number of such plates or gaps are used, the flow cross section is too small, so that problems are encountered in operation.

SUMMARY OF THE INVENTION

The invention, on the other hand, is addressed to the problem of creating a stirring mill with a grinding bead separator, the separating limit of which will correspond to the upper fine material grain size, with which sieves or filters for holding out the grinding beads are avoided, and which nevertheless sufficiently assures that no grinding beads or particles of dispersion media will be able to enter into the finish-ground product.

According to the invention, the solution of this problem consists essentially in the fact that the separator is configured in the manner of the sifting rotor in a centrifugal force sifter.

The bottom of the rotor is closed by a bottom disk which is affixed to the stirrer shaft. The coarse suspension that is fed into the mill from below is ground to the desired fineness on its way upward and flows into the upper annular space between the housing wall and the sifting rotor.

The ground material together with the grinding beads contained in it is accelerated in the circumferential direction in the upper annular space and thus brought to a greater circumferential flow. The grinding beads as well as the particles of the material that are still too coarse are held back by the centrifugal force in the outer annular space, i.e., in the grinding tank, on account of their greater mass. Each bead that arrives together with the fine material stream into the vicinity of the rotor circumference is accelerated in the circumferential direction by the higher circumferential velocity/rotor velocity there prevailing, i.e., the particle is attacked by a correspondingly stronger centrifugal force acting outwardly, i.e., it is held back in the grinding tank. The fine material, however, passes between two paddles of the sifter-separator rotor into the radially inner outlet chamber and from there into the outlet line.

By means of a centrifugal force sifter it is easily possible to separate or hold back the coarser particles at the necessary low boundary of separation of about 40 μm and less. The boundary of separation of a centrifugal force rotor is, of course, all the lower as the rotatory speed and radius are higher, since the centrifugal force increases with the rotatory speed and the square of the radius. Thus, as the rotatory speed increases and the radius increases, increasingly finer particles are held back by the centrifugal force against the flow produced in the outlet line by a vacuum or suction.

The separation or hold-out then takes place on the outer circumference of the sifter rotor. Thus, uniform separating conditions are obtained on a relatively great separating surface area corresponding to the radius and the axial height of the sifting rotor, so that the possibility is all the less that excessively large particles will be entrained into the fine material in the case of irregular flow or irregular centrifugal force. So the result is little or no excessively coarse granules (grinding beads or lime particles) in the fine material.

Advantageously, a rotor of appropriate dimensions can be locked directly onto the shaft of the stirring mechanism, so that no separate drive for the sifter rotor is necessary. But since in this type of construction the rotatory speed of the sifter rotor is equal to the rotatory speed of the grinding mechanism, then to achieve the desired fine dividing limit of about 40 μm the radius of the rotor must be greater than the radius of the grinding mechanism. The sifter rotor is therefore housed in an upper part of the housing or in a unit superimposed on the latter, which will have a correspondingly greater diameter. For a uniform flow and especially for the sinking of the particles rejected by the sifter rotor it is desirable that the annular space between the sifter rotor and the housing wall be relatively great.

In a correspondingly large upper housing part, however, a plurality of smaller sifter rotors can be contained, each of which can be driven separately at the desired speed, independently of the stirring mechanism.

Or else a sifter rotor is journaled on the stirring mechanism's shaft and driven by a separate drive or by the stirrer shaft through a countershaft.

In practical testing it was found that, surprisingly, less coarse grain, i.e., oversize grits, are present in the fines that have passed through the sifter rotor. This very important result can probably be attributed to the following effect, among others: Due to the friction the temperature in the mill rises to more than 100° C. By that time, therefore, steam bubbles are forming in the mill. The steam bubbles disturb the flow at the outlet from the mill, the flow remains irregular, the velocity changes, and thus coarser particles are forced or pulled at various points through the sieve or the partial coating of the sieve.

The sifter rotor used according to the invention, however, uses the centrifugal force to build up a pressure. In operation, therefore, an over-pressure of several bar is produced in the grinding chamber, outside of the sifter rotor (in the direction of flow). At this over-pressure the boiling point rises accordingly. Thus the formation of steam bubbles and the movement of oversize grits into the interior of the sifter rotor caused thereby is prevented, thanks to the sifter rotor as a hold-back means.

In another embodiment an expansion chamber provided with a vapor outlet is provided on the outlet side of the sifter rotor so as to receive and remove the water vapor developing behind the rotor paddles due to the pressure drop.

The product or fine materials must of course satisfy various quality requirements depending on how they are to be used. There are cases in which coarse or oversize grits are especially harmful.

In another embodiment of the invention, therefore, a mill circuit is proposed in which the fines removed by (at least) one sifter rotor at the outlet side of the grinding tank are not, as they were formerly, to be used directly as end product but are delivered to a fine sieve or a centrifuge. The fines from this fine sieve or this centrifuge serve now as the end product from which any coarse grain has been removed; the coarse grits from the centrifuge are returned into the mill, advantageously together with the raw dispersion.

The seal between the upper end ring of the sifter rotor and the upper tank wall can be provided in any way approved in the state of the art, e.g., by labyrinth seals. One particular seal is characterized by the fact that on the upper end ring of the sifter rotor a crown of radially extending rods is provided as a seal against an upper, circular wall of the grinding tank.

In like manner, the seal between the stirrer shaft and the top cover of the housing can be provided by a set of radial slinging rods.

BRIEF DESCRIPTION OF THE DRAWINGS

Embodiments of the invention are described below in conjunction with the drawing.

DETAILED DESCRIPTION OF THE INVENTION

Figure 1:
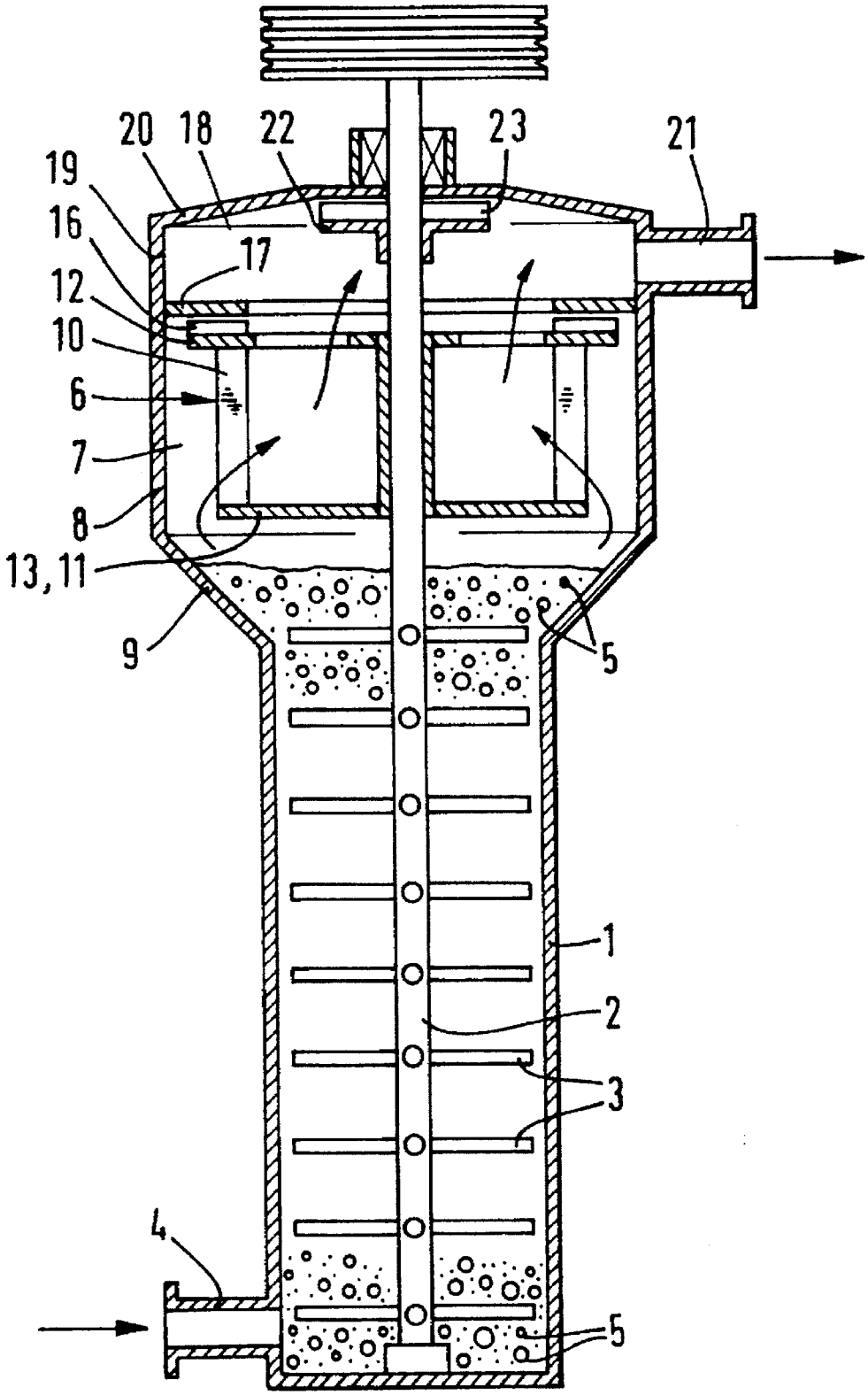
FIG. 1 shows an axial section through a stirring mill which is provided on its outlet end with a sifter-separator according to the invention.
Figure 2:
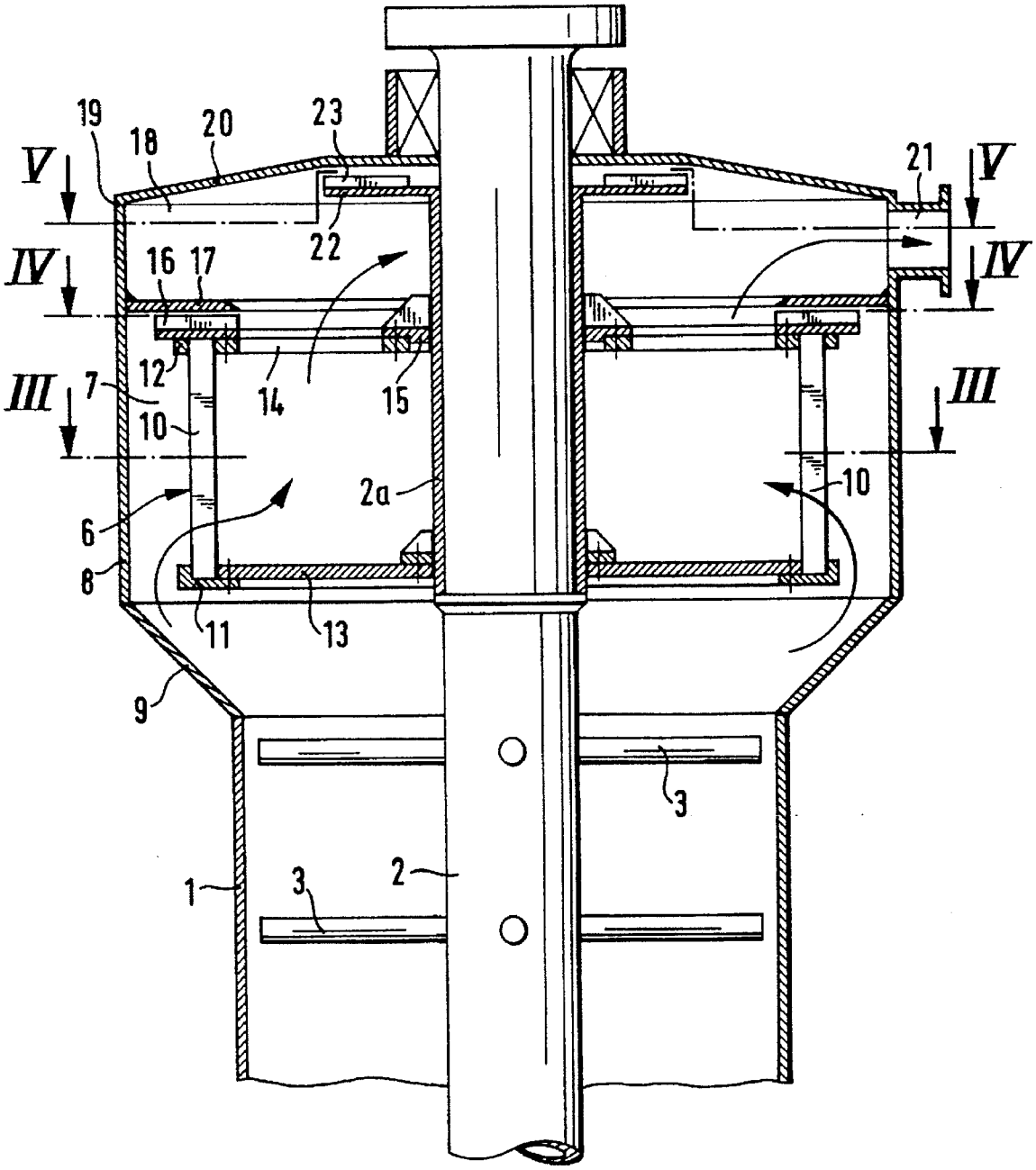
FIG. 2 shows on a larger scale the upper area of the mill in an axial section with the sifter-separator according to the invention.
Figure 3:
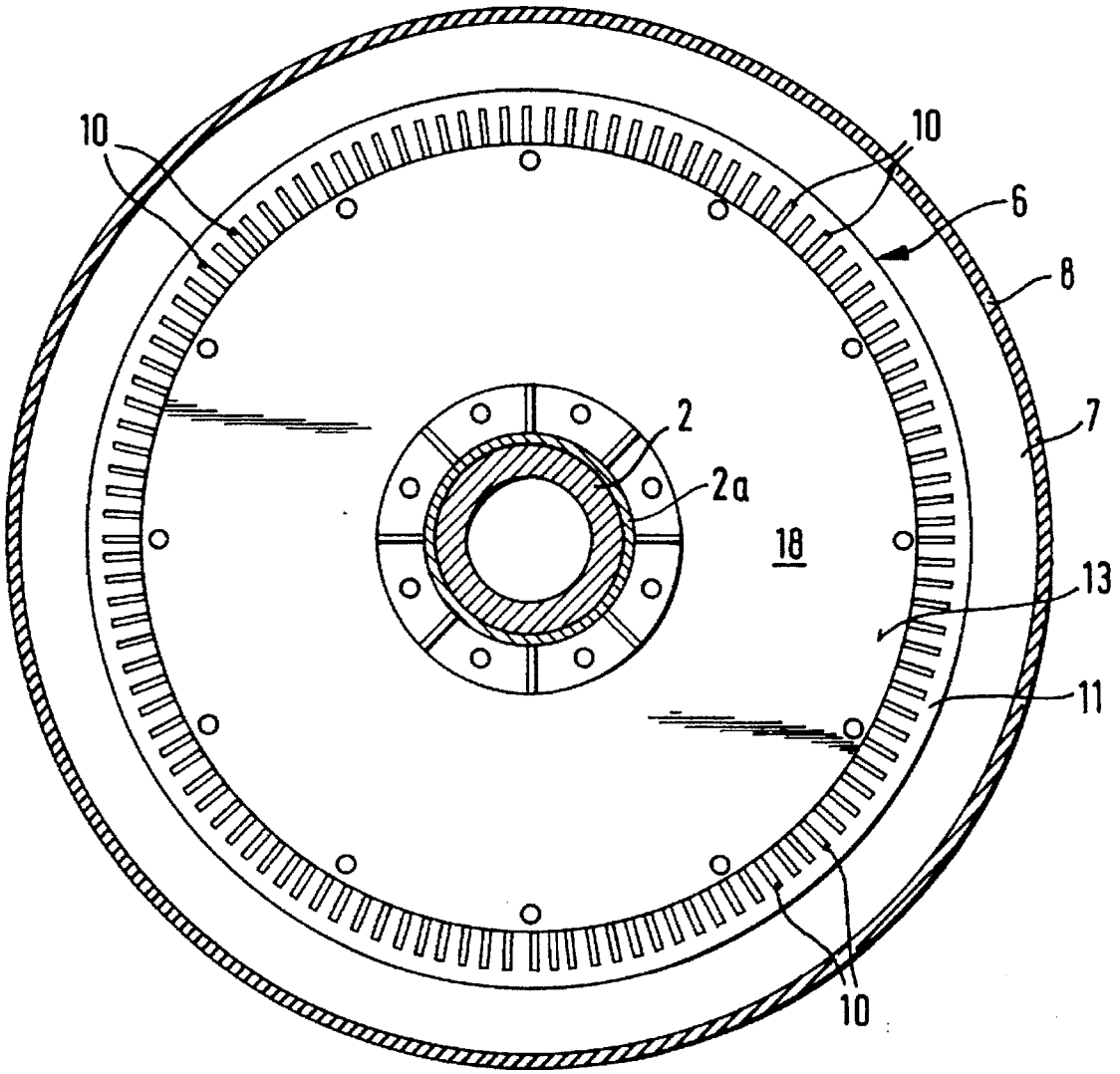
FIG. 3 is the radial section along line III—III in FIG. 2.
Figure 4:
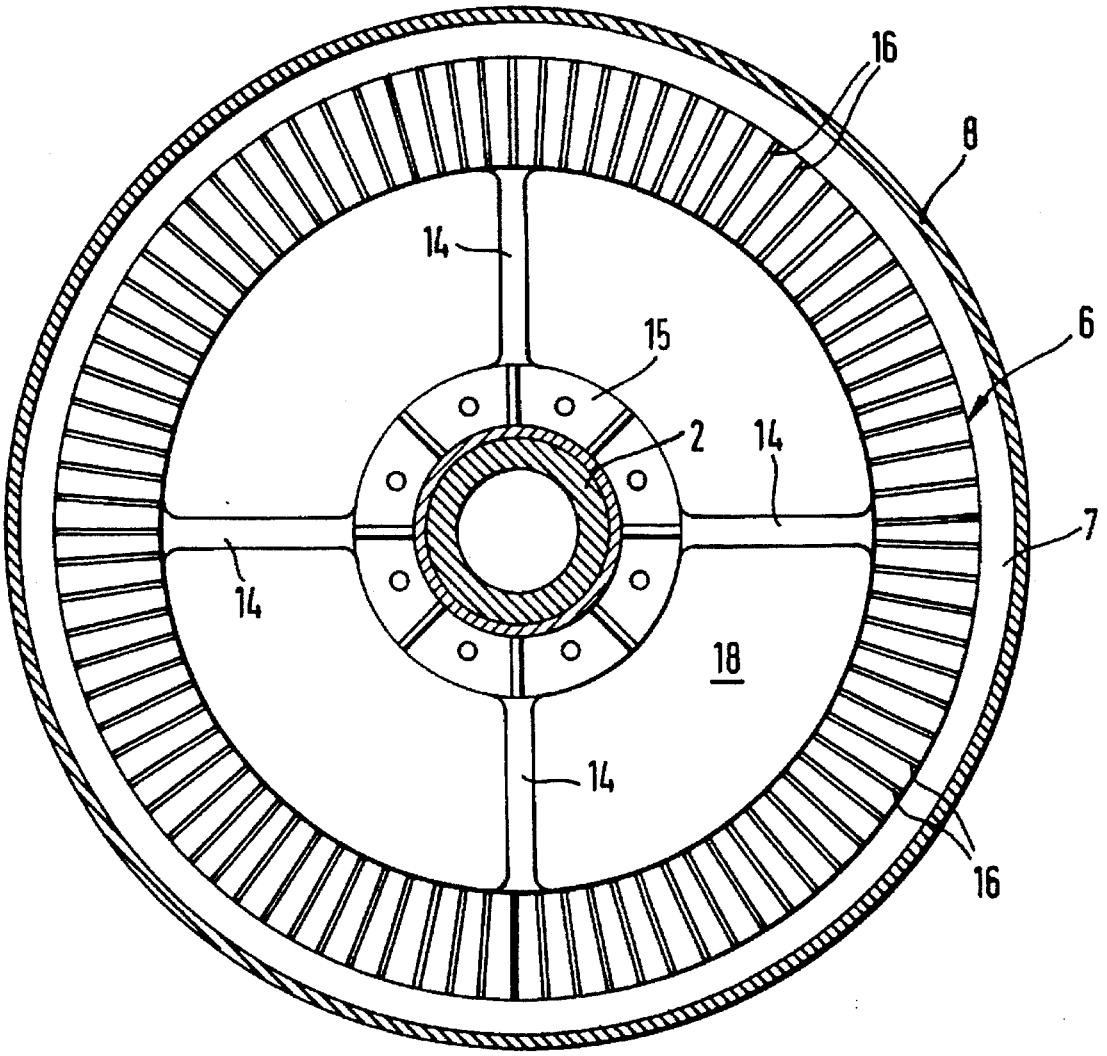
FIG. 4 shows the section along line IV—IV in FIG. 2, namely the section through the seal between the sifter rotor and the upper end ring of the housing.
Figure 5:
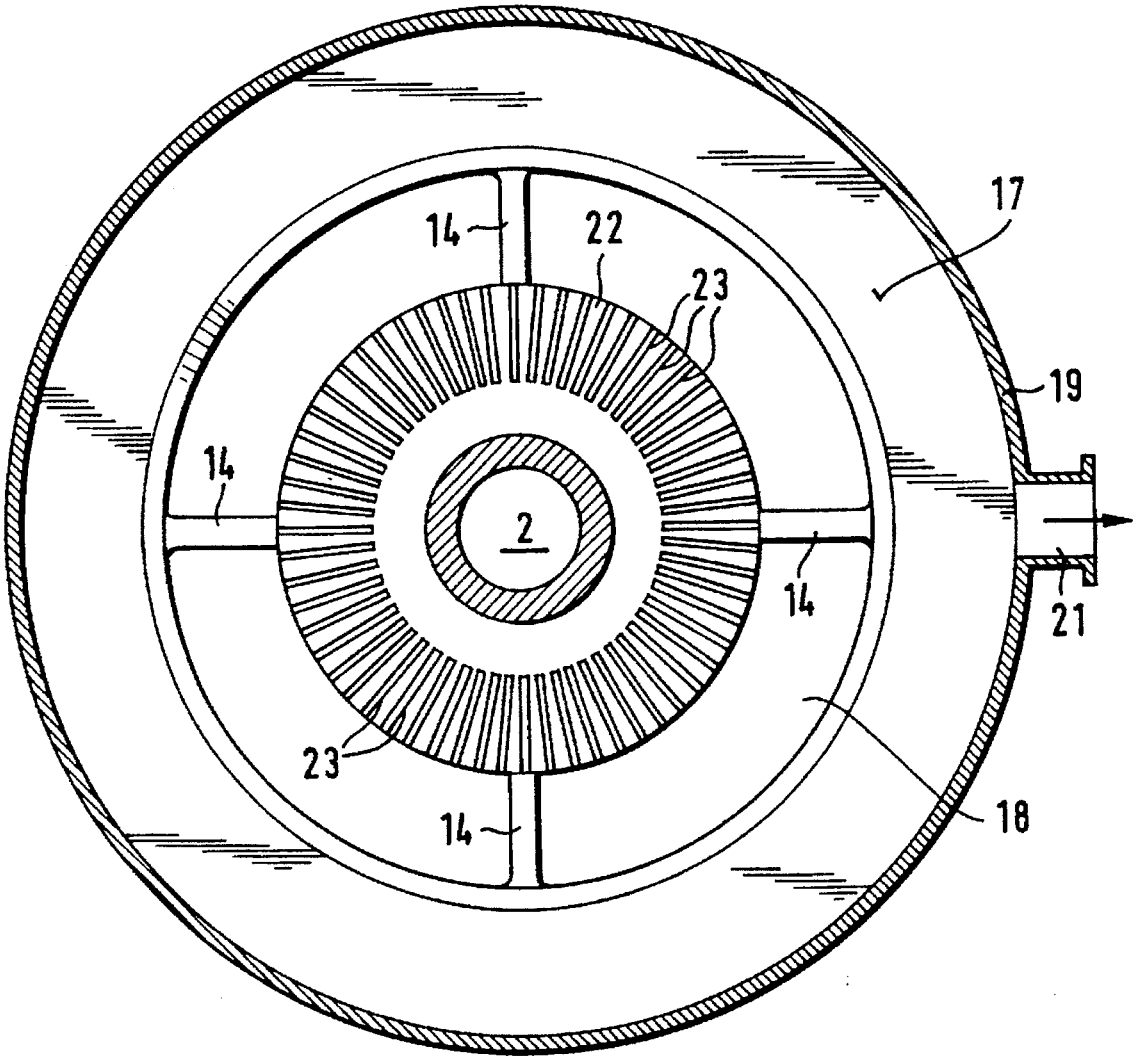
FIG. 5 shows, in the section along line V—V in FIG. 2, the seal between the shaft and the top housing cover.

The stirring bead mill consists of a cylindrical grinding tank 1, vertical in this example, in which a stirrer can rotate. The stirring mechanism consists of the stirring shaft 2, which is equipped with radially extending stirrers 3. The raw suspension to be ground is introduced through a connection 4 at the bottom end of the stirring tank. In the stirring tank there is a charge of grinding beads 5 which during operation are worn down or reduced by attrition to increasingly finer particle sizes. The interaction of larger and smaller grinding beads promotes the grinding effect. Insofar as possible, the grinding beads are to be retained in the mill until the smaller beads have been reduced by the larger ones to the fineness of the fine material. According to the invention, a sifter rotor 6 is disposed for this purpose at the outlet end, i.e., in this case at the upper end of the grinding tank. As seen in FIGS. 1 and 2, the sifter rotor is fixedly mounted on the shaft of the stirring mechanism, that is, it is driven by the stirring shaft 2, so that no separate drive is necessary. In order to achieve greater centrifugal force and thus a finer boundary of separation, the diameter of the sifter rotor 6 is greater than the diameter or radial length of the stirrers 3. Aside from that, a relatively broad annular chamber 7 surrounding the sifter rotor will favor the separating action. The sifter rotor 6 is therefore situated in an upper expansion 8 of the housing; a conical transition 9 leads from the normal outside diameter of the grinding tank up to the greater outside diameter for the purpose of holding back the grinding beads and large grains.

The rotor paddles 10 or vanes of the sifter rotor 6 are held fixed between a bottom end ring 11 and a top end ring 12. The bottom end ring is mounted on a support disk 13 whose radially inside margin is fastened to the stirring shaft 2 and on a sleeve **2*a* tightly seated on the latter. The upper end ring 12 of the rotor is connected by radial arms 14 to a ring 15 also fastened on the sleeve 2*a***.

On the top end ring 12 of the sifter rotor sits a crown of radial rods 16 by which the sifter rotor is sealed at the top against a separating ring disk 17 which separates the upper end of the grinding chamber 7, or coarse material chamber, from the separate fines collecting chamber 18, which in turn is formed between this separating ring disk 17, a circumferential wall 19 and a shallow conical upper housing wall 20. A fines tube 21 leads into this circumferential wall and the fine slurry ground in the mill and separated by the sifter rotor 6 from the still too coarse material flows out through it. The stirring (and sifting) shaft **2/2*a* bears a ring 22 underneath the top covering; in the interstice between this ring 22 and the top covering 20 is an additional crown of radial rods 23 by which the fines chamber 18** is sealed against the outer atmosphere.

Figure 6:
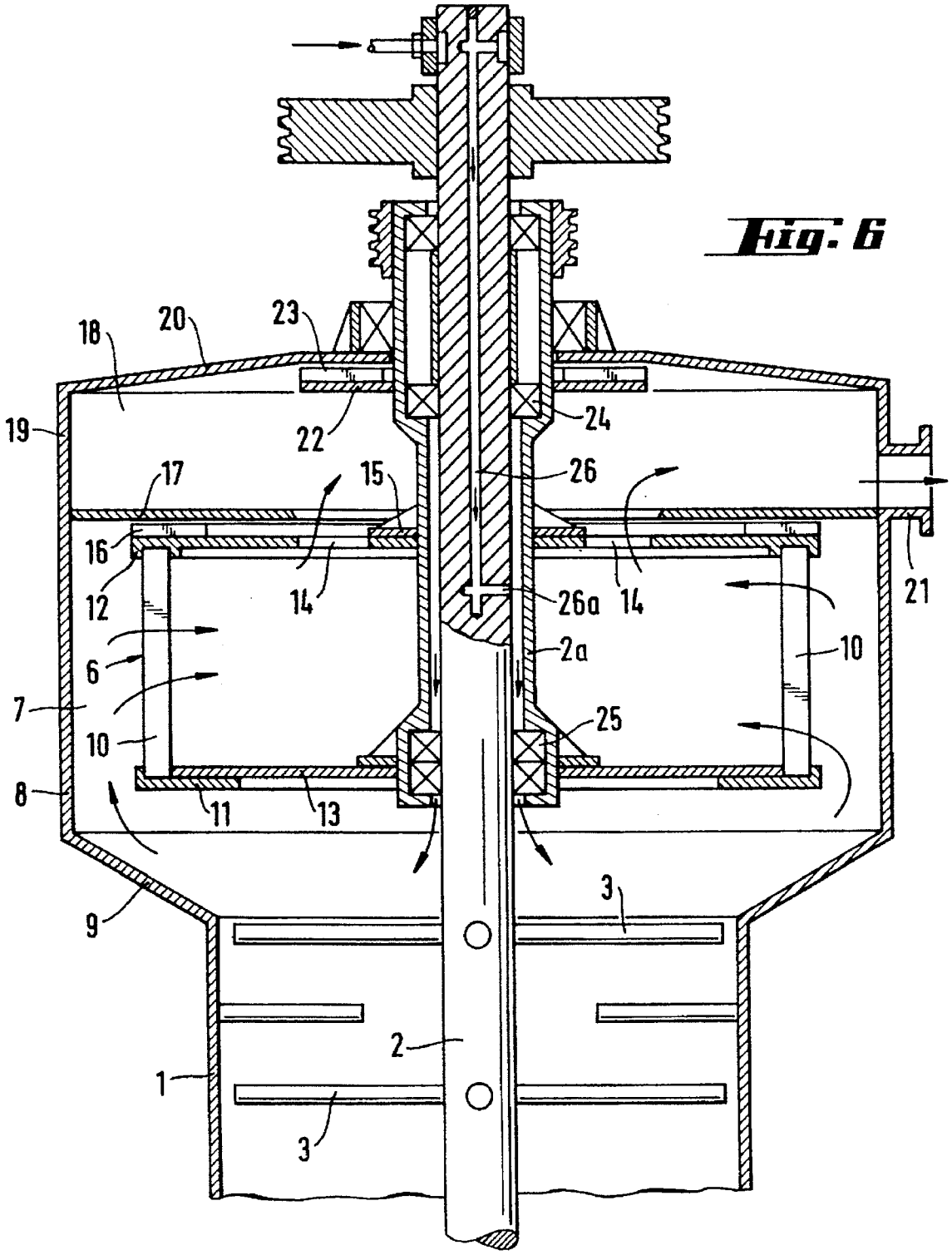
FIG. 6 shows another embodiment of the invention, represented as in FIG. 2.

In the embodiment according to FIG. 6, the sifter rotor 6 is journaled on the stirring mechanism shaft 2 by two bearings 24 and 25. A flushing substance, e.g., water or a dispersant sometimes required in the mill, is fed through an axial bore 26 and a radial bore **26*a***.

The drive of sifter rotor can be provided by the stirrer shaft or its drive mechanism, e.g., through a countershaft, whereby the rotatory speed of the stirrer shaft can be raised to the required higher rotatory speed of the sifter rotor.

Figure 7:
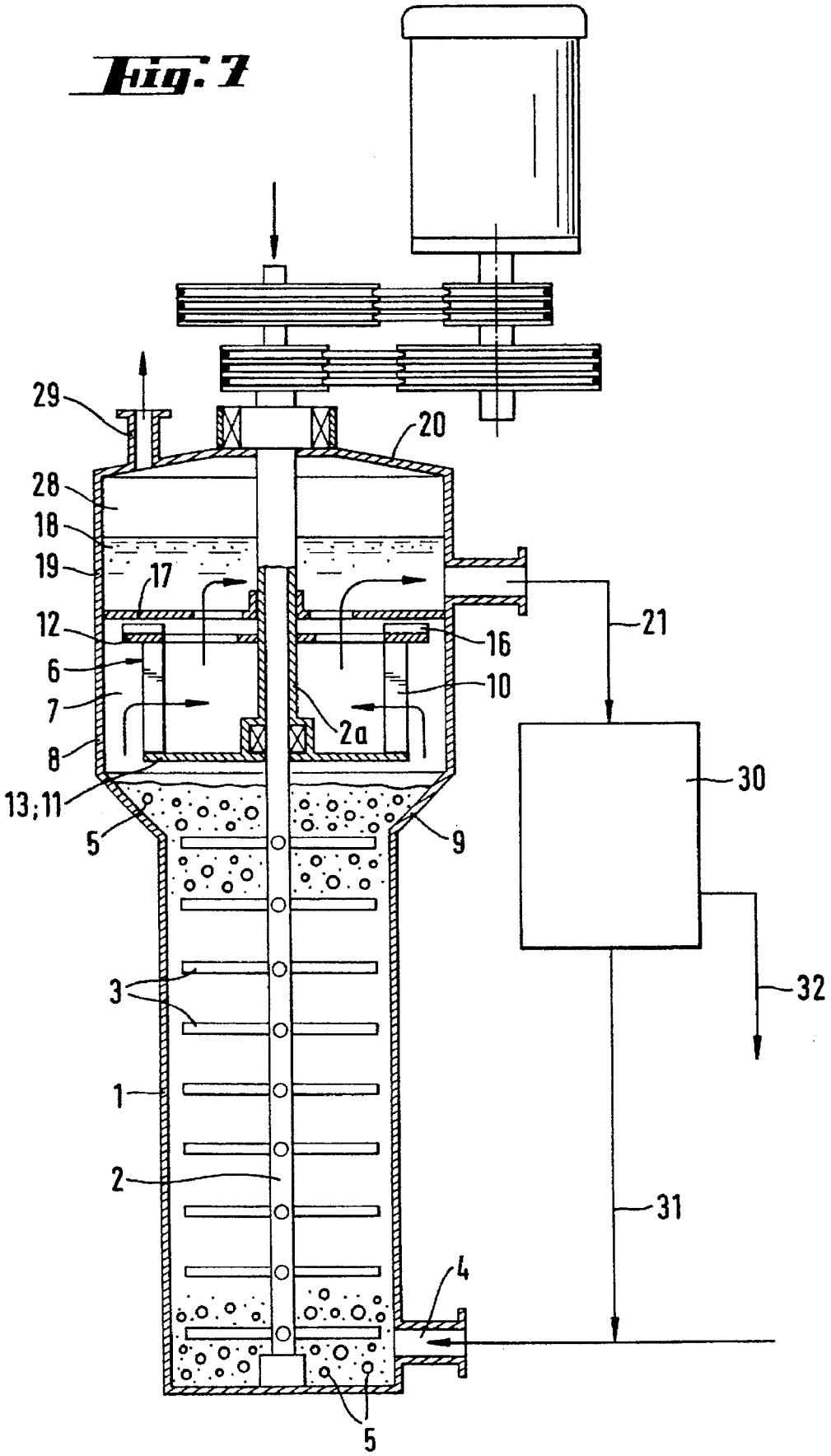
FIG. 7 shows a mill circuit with a mill substantially as in FIG. 6.

In FIG. 7, a special expansion chamber or steam chamber 28 is provided above the outlet from the sifter rotor and serves especially to receive the water vapor that forms due to the pressure drop behind the rotor paddles 10. The water vapor collecting above the surface of the fine suspension can escape through the outlet 29.

Accidentally, a number of coarse oversize particles may also be present in the fine slurry product separated by the sifter rotor. The amount of these oversize particles depends on the operating conditions. In particular, at higher throughputs a greater amount of oversize grits must be expected. In certain products such oversize materials are especially harmful.

To eliminate such oversize materials—and thereby achieve the greatest possible throughput made possible by the use of the sifter rotor as means for holding out coarse grains, even in the case of difficult products or conditions, the fines outlet 21 of the stirring mill is, in a further embodiment of the invention, connected to a centrifuge 30 by means of which these oversize particles are separated. The coarse-grain outlet 31 from the centrifuge is therefore connected to the inlet 4 of the stirring mill, while the fines outlet 32 of the centrifuge delivers the final fine material product. (FIG. 7)

I claim:

1. A stirring mill having a grinding tank for holding a charge of grinding beads, an inlet, an outlet, a stirring shaft provided with rotatable stirring means, and a separator mounted on the stirring shaft for holding back the grinding beads ahead of the outlet, an outer annular chamber formed between an outer circumference of the separator and an inner circumference of the grinding tank, and an inner outlet chamber annularly surrounding the stirring shaft and extending to the outer circumference of the separator, the separator being formed as a centrifugal force sifting rotor, comprising a plurality of circumferentially arranged, axially oriented, spaced-apart paddles, having a plurality of first openings therebetween, the first openings communicating the outer annular chamber with the inner outlet chamber, the separator further comprising at least one radial second opening communicating the inner outlet chamber with the outlet, and a seal means for selectively preventing direct passage of particles over a certain chosen size between the outer annular chamber and the outlet.

2. Stirring mill according to claim 1, wherein the sifter rotor is disposed in an upper part of expanded diameter of the grinding tank.

3. Stirring mill according to claim 1, wherein an expansion and vapor collecting chamber provided with a vapor outlet is provided at the outlet side of the sifter rotor to receive and remove the water vapor that forms on account of the pressure drop behind the rotor paddles.

4. Stirring mill, according to claim 1, wherein on an upper end ring of the sifter rotor a crown of radially extending rods is provided as a seal against an upper, circular wall of the grinding tank.

5. Stirring mill according to claim 4, wherein, as a seal between the stirring shaft and an upper housing top, a crown of radial rods is disposed on a supporting ring surrounding the shaft.

6. Mill circuit with at least one stirring mill according to claim 1, wherein the fine material outlet of the stirring mill is connected to a separating apparatus having a coarse material outlet connected with the inlet of the stirring mill, while the fines outlet delivers the fine material end product.

7. A stirring mill having a grinding tank for holding a charge of grinding beads, the tank having an inlet and an outlet and a stirring shaft provided with rotatable stirring means, wherein a device for holding back the grinding beads is provided at the outlet side of the grinding tank, wherein at least one separately driven sifter rotor is provided in an upper part of expanded diameter of the grinding tank.

8. Stirring mill according to claim 7, wherein the sifter rotor is journaled on the stirring shaft and is driven separately from the stirring shaft.

* * * * *